US011618253B2

(12) United States Patent
McClelland et al.

(10) Patent No.: US 11,618,253 B2
(45) **Date of Patent: *Apr. 4, 2023**

(54) FLUIDIC DIE

(71) Applicant: HEWLETT-PACKARD DEVELOPMENT COMPANY, L.P., Spring, TX (US)

(72) Inventors: Sean P. McClelland, Corvallis, OR (US); Donald J. Milligan, Corvallis, OR (US); Eric T. Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 95 days.

This patent is subject to a terminal disclaimer.

(21) Appl. No.: 17/302,887

(22) Filed: May 14, 2021

(65) Prior Publication Data

US 2021/0260870 A1 Aug. 26, 2021

Related U.S. Application Data

(63) Continuation of application No. 16/474,268, filed as application No. PCT/US2017/027709 on Apr. 14, 2017, now Pat. No. 11,034,147.

(51) Int. Cl.
*B41J 2/045* (2006.01)
*B41J 2/14* (2006.01)

(52) U.S. Cl.
CPC ..... *B41J 2/0458* (2013.01); *B41J 2/04543* (2013.01); *B41J 2/04541* (2013.01);
(Continued)

(58) Field of Classification Search
None
See application file for complete search history.

(56) References Cited

U.S. PATENT DOCUMENTS 6,217,147 B1 4/2001 Holstun
6,332,677 B1 12/2001 Steinfield
(Continued)

FOREIGN PATENT DOCUMENTS

CN 1543048 11/2004
CN 1558828 12/2004
(Continued)

OTHER PUBLICATIONS

Aden, J.S. et al., The Third-generation HP Thermal Inkjet Printhead, Feb. 1994, <http://citeseerx.ist.psu.edu/viewdoc/download?doi=10.1.1.362.3312&rep=rep1&type=pdf> (5 pages).

*Primary Examiner* — Alejandro Valencia
(74) *Attorney, Agent, or Firm* — Foley & Lardner LLP

(57) ABSTRACT

A fluidic die may include a substrate supporting a fluid actuator address line and first and second groups of fluid actuators connected to the fluid actuator address line. The first group of fluid actuators may include first and second types of fluid actuators having different operating characteristics. The second group of fluid actuators may include the first and the second types of fluid actuators. The fluid actuators of the first and second groups have addresses such that a fluid actuator of the first type in the first group and a fluid actuator of the second type in the second group are both enabled in response to a single enabling event on the fluid actuator address line.

11 Claims, 9 Drawing Sheets

(52) U.S. Cl.
CPC ..... *B41J 2002/14467* (2013.01); *B41J 2002/14491* (2013.01); *B41J 2202/12* (2013.01)

(56) References Cited

U.S. PATENT DOCUMENTS

| | | | |
|---|---|---|---|
| 8,651,604 | B2 | 2/2014 | Burton |
| 8,814,293 | B2 | 8/2014 | Strunk et al. |
| 9,381,739 | B2 | 7/2016 | Govyadinov et al. |
| 11,034,147 | B2 * | 6/2021 | McClelland ..... B41J 2/0452 |
| 2009/0160898 | A1 | 6/2009 | Berqstedt et al. |
| 2009/0244132 | A1 | 10/2009 | Bruce et al. |
| 2009/0284558 | A1 | 11/2009 | Cerutti |
| 2012/0056952 | A1 | 3/2012 | Silverbrook |
| 2013/0155135 | A1 | 6/2013 | Govyadinov |

FOREIGN PATENT DOCUMENTS

| | | |
|---|---|---|
| CN | 105934344 | 9/2016 |
| JP | 2000225697 | 8/2000 |
| JP | 2013544678 | 12/2013 |
| JP | 2018505077 | 2/2018 |
| WO | WO-2015047293 | 4/2015 |
| WO | WO-2016068894 A1 | 5/2016 |
| WO | WO-2016089371 A1 | 6/2016 |

* cited by examiner

FLUIDIC DIE

CROSS REFERENCED TO RELATED APPLICATIONS

This is a continuation of U.S. application Ser. No. 16/474,268, having a national entry date of Jun. 27, 2019, which is a national stage application under 35 U.S.C. § 371 of PCT/US2017/027709, filed Apr. 14, 2017, which are both hereby incorporated by reference in their entirety.

BACKGROUND

Fluidic dies may control the movement and ejection of fluid. Such fluidic dies may include fluid actuators that may be actuated to cause displacement of fluid. Some example fluidic dies may be printheads, where the fluid may correspond to ink.

Figure 1:
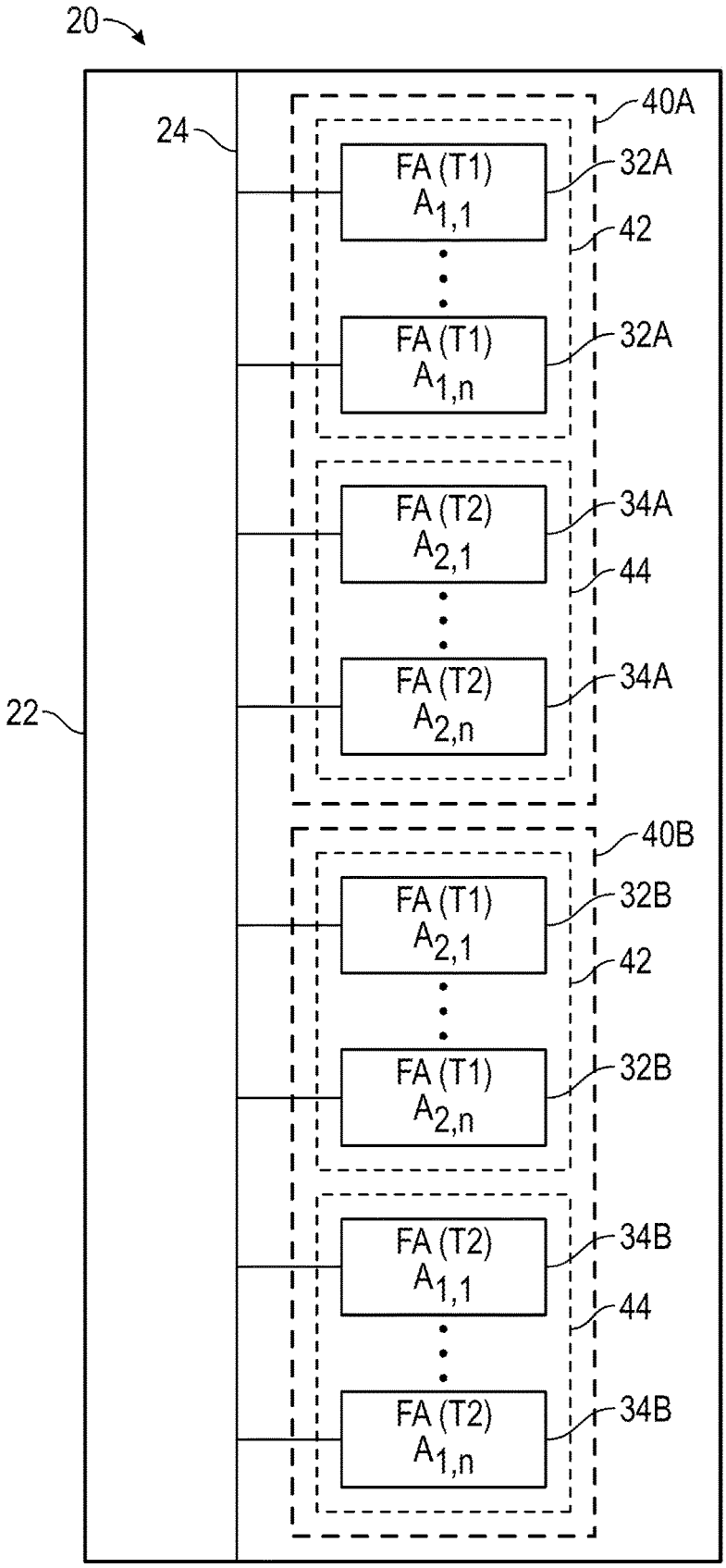
FIG. 1 is a schematic diagram of a portion of an example fluidic die.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Examples of fluidic dies may comprise fluid actuators. The fluid actuators may include a piezoelectric membrane based actuator, a thermal resistor based actuator, an electrostatic membrane actuator, a mechanical/impact driven membrane actuator, a magneto-strictive drive actuator, or other such elements that may cause displacement of fluid responsive to electrical actuation. Fluidic dies described herein may comprise a plurality of fluid actuators, which may be referred to as an array of fluid actuators. Moreover, an actuation event, as used herein, may refer to concurrent actuation of fluid actuators of the fluidic die to thereby cause fluid displacement. Despite occurring in response to a single actuation event, concurrent actuation of fluid actuators, as used herein, may include slight time delays at and between each of the concurrently actuated individual actuators such that the fluid actuators are not actuated simultaneously, reducing peak voltage demands.

In example fluidic dies, the array of fluid actuators may be arranged in respective sets of fluid actuators, where each such set of fluid actuators may be referred to as a "primitive" or a "firing primitive." A primitive generally comprises a group or set of fluid actuators that each have a unique actuation address. In some examples, electrical and fluidic constraints of a fluidic die may limit which fluid actuators of each primitive may be actuated concurrently for a given actuation event. Therefore, primitives facilitate addressing and subsequent actuation of fluid ejector subsets that may be concurrently actuated for a given actuation event. A number of fluid ejectors corresponding to a respective primitive may be referred to as a size of the primitive.

To illustrate by way of example, if a fluidic die comprises four primitives, where each respective primitive comprises eight respective fluid actuators (each eight fluid actuator group having an address 0 to 7), and electrical and fluidic constraints limit actuation to one fluid actuator per primitive, a total of four fluid actuators (one from each primitive) may be concurrently actuated for a given actuation event. For example, for a first actuation event, the respective fluid actuator of each primitive having an address of 0 may be actuated. For a second actuation event, the respective fluid actuator of each primitive having an address of 1 may be actuated. As will be appreciated, the example is provided merely for illustration purposes. Fluidic dies contemplated herein may comprise more or less fluid actuators per primitive and more or less primitives per die.

In example fluidic dies, the fluid actuators may be concurrently enabled by a single address enabling event caused by electric signals transmitted along a fluid actuator address line. As used herein, an address enabling event may refer to concurrent enablement of fluid actuators of different primitives having a same address to ready such fluid actuators for subsequent actuation in response to receiving other enabling signals. For example, actuation of a fluid actuator may occur in response to a fluid actuator receiving at least the address enabling signals transmitted across a fluid actuator address line and primitive enabling signals received across a data or primitive select line. As used herein, a fluid actuator address line may comprise a single electrically conductive line, such as a wire or trace, or a set of electrically conductive lines which cooperate to transmit a set of electrical signals to form the address enabling event.

In some examples, a fluid actuator may be disposed in a nozzle, where the nozzle may comprise a fluid chamber and a nozzle orifice in addition to the fluid actuator. The fluid actuator may be actuated such that displacement of fluid in the fluid chamber may cause ejection of a fluid drop via the nozzle orifice. Accordingly, a fluid actuator disposed in a nozzle may be referred to as a fluid ejector.

Some example fluidic dies comprise microfluidic channels. Microfluidic channels may be formed by performing etching, microfabrication (e.g., photolithography), micromachining processes, or any combination thereof in a substrate of the fluidic die. Some example substrates may include silicon based substrates, glass based substrates, gallium arsenide based substrates, and/or other such suitable types of substrates for microfabricated devices and structures. Accordingly, microfluidic channels, chambers, orifices, and/or other such features may be defined by surfaces fabricated in the substrate of a fluidic die. Furthermore, as used herein a microfluidic channel may correspond to a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Example fluidic dies described herein may comprise microfluidic channels in which fluidic actuators may be disposed. In such implementations, actuation of a fluid actuator disposed in a microfluidic channel may generate fluid displacement in the microfluidic channel. Accordingly, a fluid actuator disposed in a microfluidic channel may be referred to as a fluid pump.

In some examples described herein, a fluidic die may include a substrate supporting a fluid actuator address line and first and second primitives or sets of fluid actuators connected to the fluid actuator address line. The first primitive or set of fluid actuators may include first and second types of fluid actuators having different operating characteristics. The second primitive or set of fluid actuators may include the first and the second types of fluid actuators. The fluid actuators of the first and second sets have addresses such that a fluid actuator of the first type in the first set and a fluid actuator of the second type in the second set are both concurrently enabled in response to a single enabling event on the fluid actuator address line.

In some examples described herein, the first type of fluid actuators in the first set and the second different type of fluid actuators in the second set each have a first set of addresses while the second type of fluid actuators in the first set and the first type of fluid actuators in the second set each have a second set of addresses. In some examples, the first set of addresses are even numbered addresses while the second set of addresses are odd numbered addresses.

In some examples described herein, the first type of fluid actuators has a first actuation energy demand, wherein the second type of fluid actuators has a second actuation energy demand different than the first actuation energy demand. In some examples, the first type of fluid actuators is to eject fluid through corresponding nozzles, wherein the second type of fluid actuators is to circulate fluid to a firing chamber. In some examples, fluid actuators of the first type alternate with the fluid actuators of the second type in the first and second sets of fluid actuators.

Disclosed herein are example methods, wherein a single address enabling event is transmitted on a fluid actuator address line of a fluidic die to each of a first set of fluid actuators and a second set of fluid actuators. The single address enabling event is to enable a single fluid actuator for actuation in each of the first set and the second set. The example method may include enabling a first fluid actuator of a first type of fluid actuators in the first set of fluid actuators in response to the single address enabling event and enabling a second fluid actuator of a second type of fluid actuators in the second set of fluid actuators, in response to the single address enabling event. The second type of fluid actuators each have an operational characteristic different than that of the first type of fluid actuators. The method may further include transmitting a fluid actuator enabling event to the first set of fluid actuators and the second set of fluid actuators. The first fluid actuator may be actuated in response to a combination of the first fluid actuator being enabled by the single address enabling event and the first fluid actuator receiving the fluid actuator enabling event. The second fluid actuator may be actuated in response to a combination of the second fluid actuator being enabled by the single address enabling event and the second fluid actuator receiving the fluid actuator enabling event.

FIG. 1 is a schematic diagram illustrating portions of an example fluidic die 20. Fluidic die 20 comprises substrate 22, fluid actuator address line 24 and fluid actuators 32A, 32B (collectively referred to as fluid actuators 32) and fluid actuators 34A, 34B (collectively referred to as fluid actuators 34. Fluid actuator address line 24 comprises at least one electrically conductive wire or trace by which electrical signals are transmitted to logic associated with each of the fluid actuators 32, 34 to enable actuators 32, 34 for possible subsequent actuation during an actuation event. In one implementation, fluid actuator address line 24 comprises multiple electrically conductive wires or traces. For example, fluid actuator address line 24 may comprise at least three bits or three individual bit lines.

Fluid actuators 32 and 34 comprise devices or elements that cause displacement of a fluid in response to electrical actuation. The fluid actuators 32, 34 may include a piezoelectric membrane based actuator, a thermal resistor based actuator, an electrostatic membrane actuator, a mechanical/impact driven membrane actuator, a magneto-strictive drive actuator, or other such elements.

Fluid actuators 32 have different operating characteristics as compared to fluid actuators 34. In one implementation, fluid actuators 32 have different energy demands or utilize different voltage levels, current or energy during actuation than that of fluid actuators 34. In one implementation, fluid actuators 32 are in the form of fluid ejectors whereas fluid actuators 34 are in the form of fluid pumps. A fluid ejector may comprise an actuator that displaces fluid in an ejection chamber through an orifice. A fluid pump may comprise an actuator that displaces fluid in a microfluidic channel. In one implementation, fluid actuators 32 and 34 may both comprise fluid ejectors, but where fluid actuators 32 and 34 have different drop weights or other different operational characteristics. In one implementation, fluid actuator 32 and 34 may both comprise fluid pumps, but where fluid actuators 32 and 34 have different energy voltage demands.

As indicated by broken lines in FIG. 1, fluid actuators 32A and 34A, collectively, form a first set 40A of fluid actuators while fluid actuators 32B and 34B, collectively, form a second set 40B of fluid actuators. Sets 40A and 40B (collectively referred to as sets 40) extend adjacent to one another or are consecutive on substrate 22. Each of sets 40 comprises a subset 42 of fluid actuators 32 and a subset 44 of fluid actuators 34. Although FIG. 1 illustrates such actuators 32, 34 physically arranged in columns, in other implementations, actuators 32, 34 may be in rows, arrays or other physical arrangements.

Sets 40 form what may be referred to as primitives of fluidic die 20, each set having a same set of addresses. In other words, each fluid actuator in set 40A has an address that is the same as the address of a fluid actuator in set 40B. Although each of sets 40 has a same set of addresses, the addresses of the sets 40A and 40B are oppositely apportioned between the different types fluid actuators. In the example illustrated, the fluid actuators of each of sets 40 have a set of addresses comprising addresses $A_{1,1}$ to $A_{1,n}$ and addresses $A_{2,1}$ to $A_{2,n}$. However, in set 40A, fluid actuators 32A have addresses $A_{1,1}$ to $A_{1,n}$, whereas in set 40B, fluid actuators 32B have addresses $A_{2,1}$ to $A_{2,n}$. Likewise, in set 40A, fluid actuators 34A have addresses $A_{2,1}$ to $A_{2,n}$, whereas in set 40B, fluid actuators 34B have addresses $A_{1,1}$ to $A_{1,n}$.

Because the same sets of addresses in sets 40 are oppositely apportioned between the different types of fluid actuators 32, 34 in each set 40, a single address enabling event on address line 24 concurrently enables different types of fluid actuators in the different sets 40. For example, a single address enabling event resulting in the transmission of address enabling signals across address line 24 to enable address $A_{1,1}$ may result in fluid actuator 32A (of a first type T1) of set 40A being enabled for a subsequent actuation event while also resulting in fluid actuator 34B (of a second type T2) being enabled for the same subsequent actuation event. By way of another example, a single address enabling event resulting in the transmission of address enabling signals across address line 24 to enable address $A_{2,1}$ may result in fluid actuator 34A (of the second type T2) of set 40A being enabled for a subsequent actuation event while also resulting in fluid actuator 32B (of the first type T1) being enabled for the same subsequent actuation event.

The example addressing scheme of fluidic die 20 may facilitate more flexibility in the actuation order of fluid actuators 32, 34. In examples where fluid actuators 32, 34 have different energy demands, the example addressing scheme of fluid die 20 may facilitate reduced peak currents. For example, in one implementation where fluid actuator 32 comprise fluid ejectors which may have higher energy demands and fluid actuators 34 comprise fluid pumps having lower energy demands or peak currents, the number of fluid ejectors is spread out over the total number of addresses in each set 40, resulting in half, rather than all, of the total number of fluid ejectors being enabled for possible actuation during a subsequent actuation event. In other words, the first half of the fluid ejectors may be enabled for possible actuation during a first actuation event while a second half of the fluid actuators may be enabled for possible actuation during a second actuation event.

Although fluid actuators 32 and 34 are each schematically illustrated as comprising fluid actuators that are clustered or grouped in each of sets 40, it should be appreciated that the different fluid actuators 32, 34 may be interspersed amongst one another in each set 40. For example, in one implementation, fluid actuators 32 and 34 may alternate with one another in each set 40. Fluid actuators 32 may have even addresses while fluid actuators 34 have odd addresses, or vice versa. Regardless of location or relative positioning on die 20, each fluid actuator of a first type in set 40A with a given address has a corresponding fluid actuator of a second type in 40B with the same given address.

Figure 2:
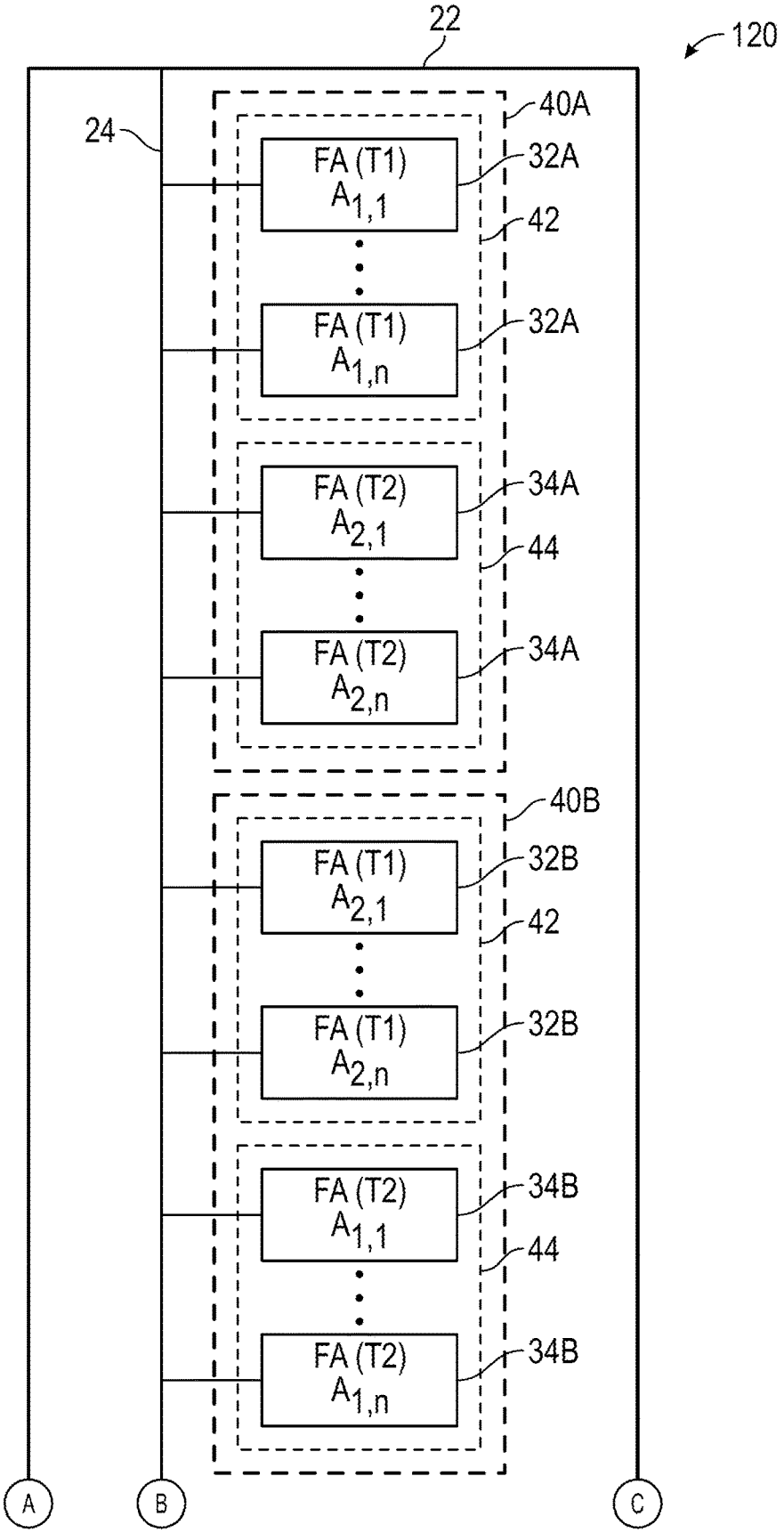
FIG. 2 is a schematic diagram of a portion of another example fluidic die.
Figure 2:
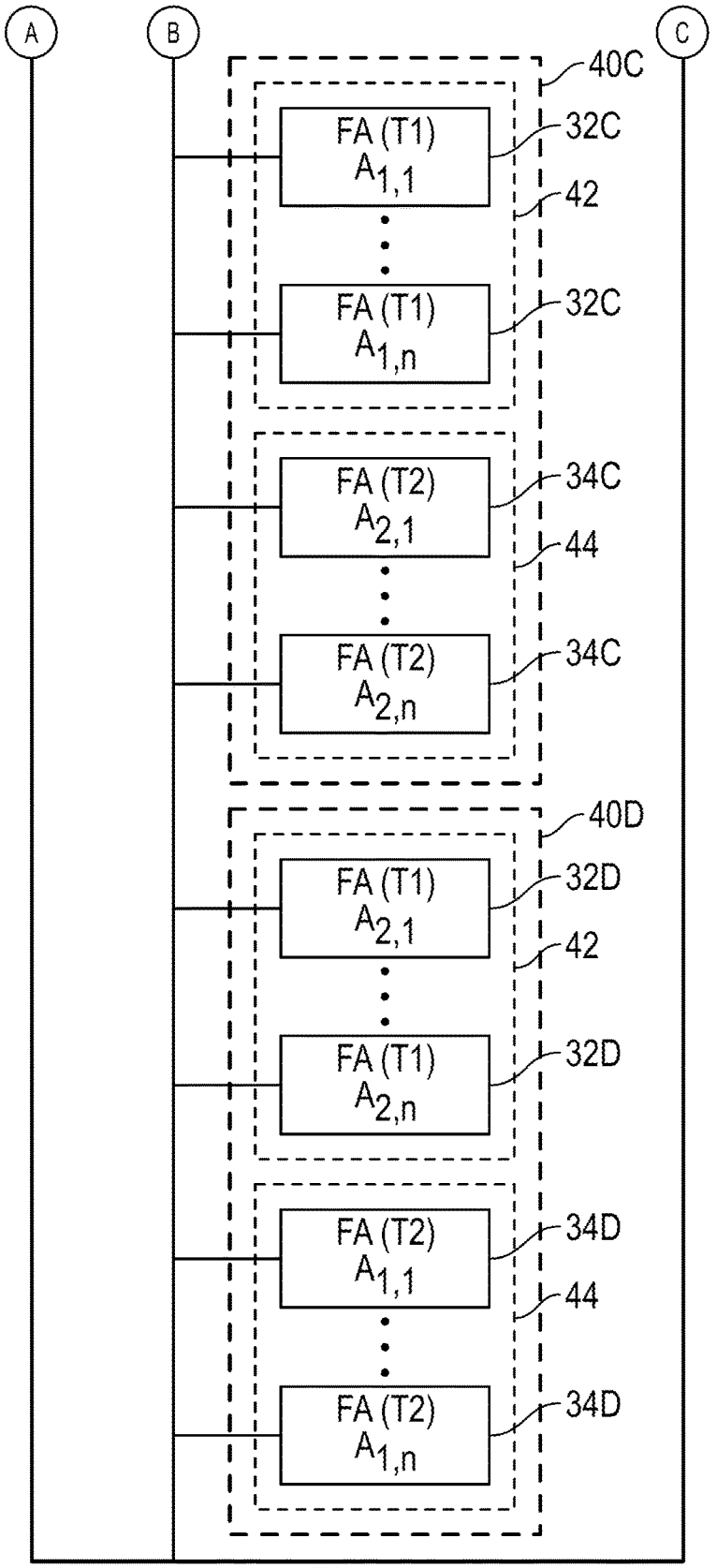

FIG. 2 is a schematic diagram of portions of fluidic die 120. Fluidic die 120 is similar to fluidic die 20 except that fluidic die 120 is illustrated as comprising at least four consecutive primitives or sets 40 of fluid actuators 32, 34. Those components of fluidic die 120 which correspond to components of fluidic die 20 are numbered similarly. Although FIG. 2 illustrates such actuators 32, 34 physically arranged in columns, in other implementations, actuators 32, 34 may be in rows, arrays or other physical arrangements.

As shown by FIG. 2, fluidic die 120 additionally comprises sets 40C and 40D of fluid actuators 32C, 34C, 32D, 34D, respectively. Fluid actuators 32C, 32D may be similar to fluid actuators 32A and 32B, respectively. Likewise, fluid actuators 34C, 34D may be similar to fluid actuators 34A and 34B, respectively. With respect to fluidic die 120, fluid actuators 32A-32C and fluid actuators 34A-34D are collectively referred to as fluid actuators 32 and fluid actuators 34, respectively. Fluid actuators 32 and 34 are all connected to fluid actuator address line 24 which transmits address enabling signals as part of an address enabling event to enable a selected address long address line 24 for possible subsequent actuation during a subsequent actuation event.

As with fluidic die 20, because the same sets of addresses in each of sets 40 are oppositely apportioned between the different types of fluid actuators 32, 34 in each set 40, a single address enabling event on address line 24 concurrently enables different types of fluid actuators in the different sets 40. For example, a single address enabling event resulting in the transmission of address enabling signals across address line 24 to enable address $A_{1,1}$ may result in fluid actuator 32A (of a first type T1) of set 40A being enabled for a subsequent actuation event, fluid actuator 34B (of a second type T2) being enabled for the subsequent actuation event, fluid actuator 32C (of the first type T1) of set 40C being enabled for the subsequent actuation event and fluid actuator 34D (of the second type T2) being enabled for the same subsequent actuation event. By way of another example, a single address enabling event resulting in the transmission of address enabling signals across address line 24 to enable address $A_{2,1}$ may result in fluid actuator 34A (of the second type T2) of set 40A being enabled for a subsequent actuation event, fluid actuator 32B (of the first type T1) being enabled for the subsequent actuation event, fluid actuator 34C (of the second type T2) of set 40C being enabled for the subsequent actuation event and fluid actuator 32D (of the first type T1) being enabled for the same subsequent actuation event.

Figure 3:
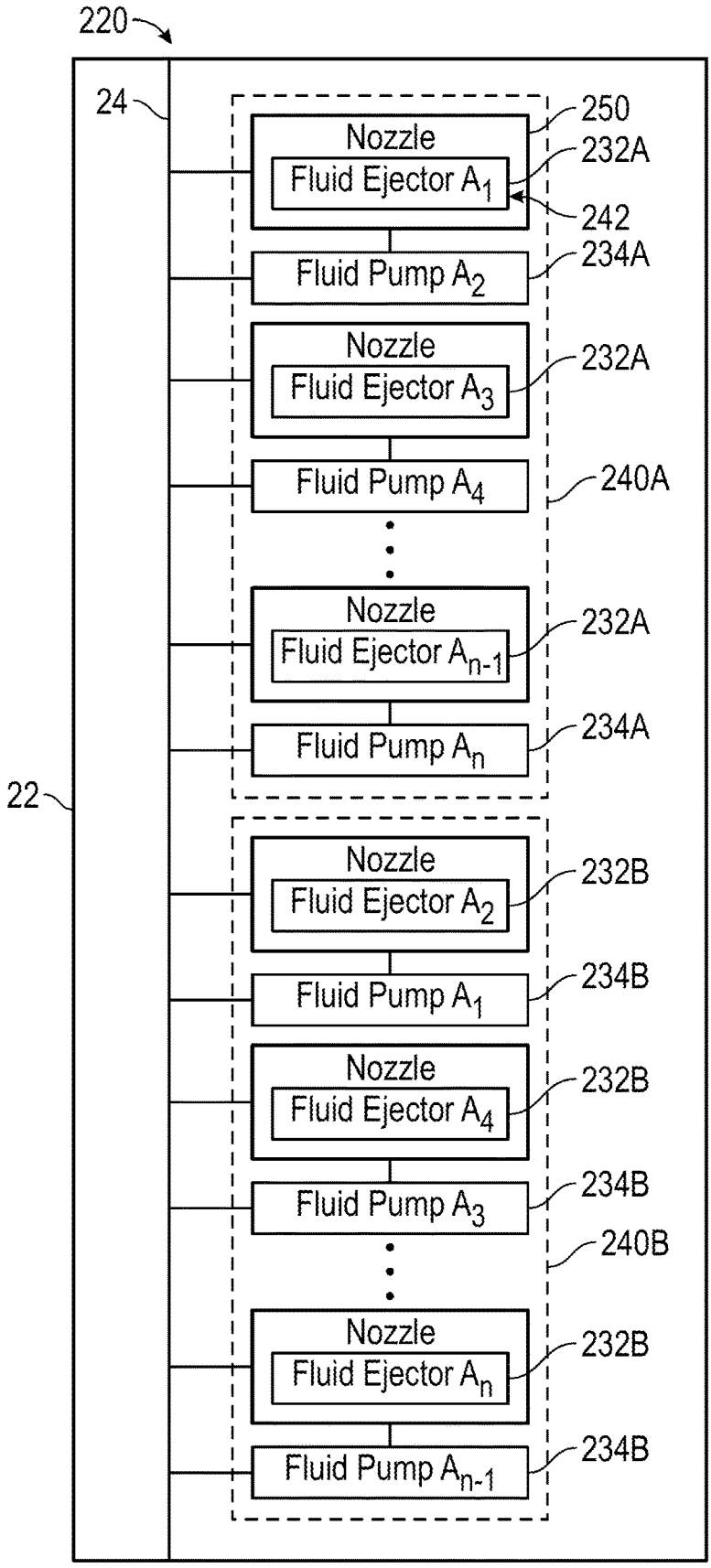
FIG. 3 is a schematic diagram of a portion of another example fluidic die.

FIG. 3 is a schematic diagram illustrating a portion of an example fluidic die 220. Fluidic die 220 is similar to fluidic dies 20 and 120 except that fluidic die 220 is specifically illustrated as having different types of fluid actuators in the form of fluid ejectors and fluid pumps that alternate with one another along address line 24. In one implementation, the fluid ejectors have different energy voltage demands as compared to the fluid pumps. Those components of fluidic die 220 which correspond to components of fluidic dies 20 and 120 are numbered similarly.

As shown by FIG. 3, fluidic die 220 comprises fluid actuators in the form of fluid ejectors 232A, 232B (collectively referred to as fluid ejectors 232) and fluid actuators in the form of fluid pumps 234A, 234B (collectively referred to as fluid pumps 234). Each fluid ejector 232 is part of a larger nozzle 250, wherein each nozzle 250 has an orifice through which fluid is ejected through the displacement caused by the associated fluid ejector 232. In the example illustrated, fluid ejectors 232/nozzles 250 and fluid pumps 234 alternate along address line 24, wherein fluid ejector 232 and fluid pumps 234 are paired, wherein a fluid pump 234 circulates fluid to and/or from a paired or associated fluid ejector 232/nozzle 250. In other implementations, the interspersed nozzles 250 and fluid pumps 234 may have other arrangements or patterns.

As indicated by broken lines, fluid ejectors 232 and fluid pumps 234 form two sets 240A and 240B (collectively referred to as sets 240) of fluid actuators. Each of sets 240 comprises a subset 242 of fluid ejectors 232 and a subset 244 of fluid pumps 234. Sets 240 form what may be referred to as primitives of fluidic die 220, each set having a same set of addresses. In other words, each fluid actuator in set 240A has an address that is the same as the address of a fluid actuator in set 240B. Although each of sets 240 has a same set of addresses, the addresses of the sets 240A and 240B are oppositely apportioned between the different types fluid actuators. In the example illustrated, the fluid actuators of each of sets 40 have a set of addresses comprising addresses A1 to An. In the example illustrated, the fluid ejectors 232A of set 240A have even addresses (for example, 0, 2, 4 . . . n−1) while the fluid pumps 234 of set 240A have the odd addresses (for example, 1, 3, 5 . . . n). Conversely, the fluid ejectors 232B of set 240B have odd addresses (for example, 1, 3, 5 . . . n) while the fluid pumps 234B have even addresses (for example, 0, 2, 4 . . . n−1).

Because the same sets of addresses in sets 240 are oppositely apportioned between the fluid ejectors 232 and fluid pumps 234 in each set 240, a single address enabling event on address line 24 concurrently enables different types of fluid actuators in the different sets 240. For example, a single address enabling event resulting in the transmission of address enabling signals across address line 24 to enable address A3 may result in fluid ejector 232A at address A3 of set 240A being enabled for a subsequent actuation event while also resulting in fluid pump 234B at address A3 of set 240B being enabled for the same subsequent actuation event. By way of another example, a single address enabling event resulting in the transmission of address enabling signals across address line 24 to enable address A4 may result in fluid pump 234A at address A4 of set 40A being enabled for a subsequent actuation event while also resulting in ejector 232B at address A4 of set 240B being enabled for the same subsequent actuation event.

The example addressing scheme of fluidic die 220 may facilitate more flexibility in the actuation order of fluid ejectors 232 and fluid pumps 234. In examples where fluid ejectors 232 and fluid pumps 234 have different energy demands, the example addressing scheme of fluid die 220 may facilitate reduced peak currents. For example, in one implementation where fluid ejectors 232 have higher energy demands and fluid pumps 34 have lower energy demands or peak currents, the number of fluid ejectors is spread out over the total number of addresses in each of sets 240, resulting in half, rather than all, of the total number of fluid ejectors being enabled for possible actuation during a subsequent actuation event. In other words, the first half of the fluid ejectors may be enabled for possible actuation during a first actuation event while a second half of the fluid actuators may be enabled for possible actuation during a second actuation event.

Figure 4:
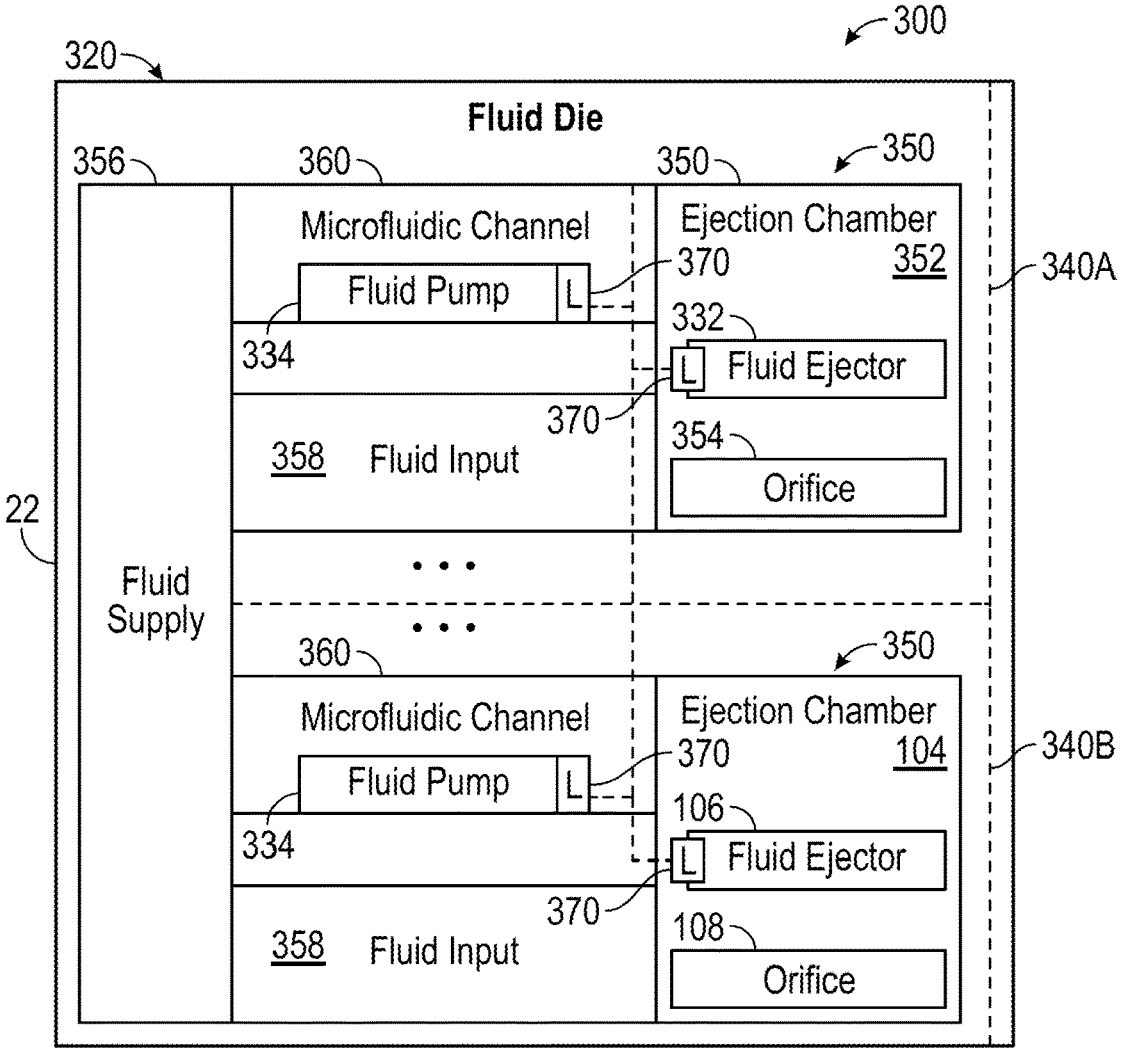
FIG. 4 is a schematic diagram of a portion of an example fluid ejection system having an example fluidic die.
Figure 5:
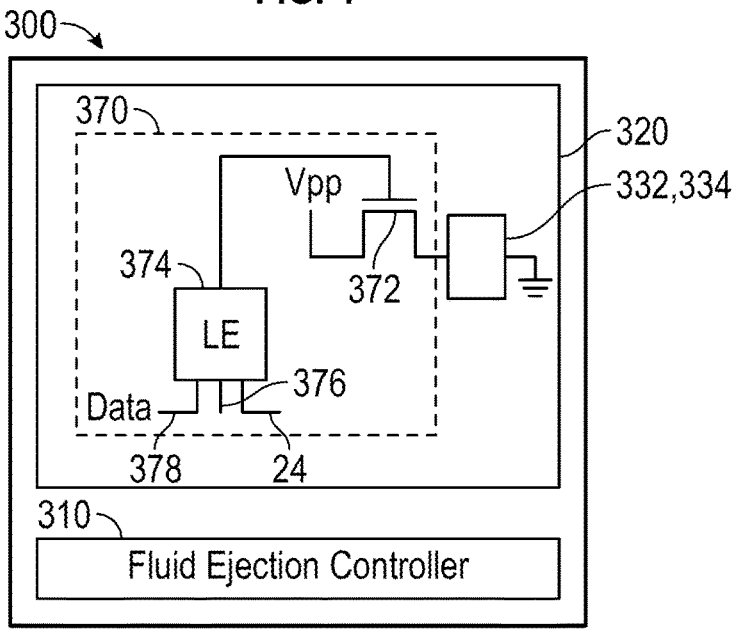
FIG. 5 is a schematic diagram of example triggering logic of the fluidic ejection system of FIG. 4.

FIGS. 4 and 5 schematically illustrate portions of an example fluid ejection system 300 having a fluid ejection controller 310 and a fluidic die 320 with the same address scheme as described above with respect to fluidic die 220. As with fluidic die 220, fluidic die 320 comprises an array of fluid actuators in the form of fluid ejectors 332 and fluid pumps 334 connected to a fluid actuator address line 24. Fluid ejectors 332 and fluid pumps 334 are paired along address line 24, wherein each of the fluid pumps 334 circulates fluid to and/or from an associated fluid ejector 332. Fluid ejectors 332 and fluid pumps 334 are arranged in primitives or sets 340A, 340B of fluid ejectors/fluid pumps. Although FIG. 4, for ease of illustration, depicts a single pair of a fluid ejector 332 and an associated pump 334 for each of sets 340A, 340B, it should be appreciated that sets 340A, 340B may each include an array of fluid ejector 332/fluid pump 334 pairs along address line 24.

As further shown by FIG. 4, each fluid ejector 332 is part of a nozzle 350 having an ejection chamber 352 having an orifice 354 and in which the fluid ejector 332 is located. Each ejection chamber 352 is fluidly connected to a fluid supply 356 by a fluid input 358 and a microfluidic channel 360. In the example illustrated, each fluid input 358 and microfluidic channel 360 facilitate circulation of fluid into ejection chamber 352, through and across ejection chamber 352 and out of ejection chamber 352 back to fluid supply 356. In the example illustrated, such circulation is facilitated by fluid pump 334 within microfluidic channel 360.

In one implementation, fluid supply 356 comprises an elongate slot supplying fluid to each of the fluid ejectors 332 in each of the sets 340 of die 320. In another implementation, fluid supply 356 may comprise an array of ink feed holes. In one implementation, fluid supply 356 further supplies fluid to primitives or sets 340 of fluid ejector 332 and fluid pumps 334 located on an opposite side of fluid supply 356. In some implementations, fluidic die 320 may comprise multiple primitives are sets similar to the arrangement shown on fluidic die 120.

In the example illustrated, each fluid ejector 332 and each fluid pump 334 comprises triggering logic (L) 370 which controls the firing or actuation of the fluid actuator, either in the form of fluid ejector 332 or in the form of fluid pump 334. FIG. 5 schematically illustrates one example of triggering logic 370 on fluidic die 320 and associated with a fluid actuator in the form of a fluid ejector 332 or a fluid pump 334. As shown by FIG. 5, triggering logic 370 comprises a transistor 372 and logic element (LE) 374. Transistor 372 is a switch selectively transmitting a voltage Vpp to fluid ejector 332 or fluid pump 334 in response to a signal received from logic element 374.

The logic element 374 comprises electronic circuitry and components that pass and actuation or fire signal to transistor 372 in response to the primitive enabling line or address line 378 and the address line 24 both being active. In one implementation, logic element 374 comprises a gate or other AND logic circuitry (schematically illustrated) that transmits the control signals or fire pulse signal received from a fire pulse line 376 to the gate of transistor 372 in response to receiving an address signal from address line 24 and also receiving a primitive enabling data signal from a data, primitive select or primitive enabling line 378. Although not shown in FIG. 4 for ease of illustration, fire pulse line 376 and primitive enabling line 378 also reside on substrate 22 of fluidic die 320. In other implementations, logic element 374 may comprise other forms of electrical circuitry. For example, in other implementations, primitive enabling data signals and fire pulse signals may be combined upstream (such as at the primitive level) or may be inverted.

It should be appreciated that in some implementations, the different types of fluid actuators, such as the fluid ejectors 332 and the fluid pumps 334 may have separate or dedicated fire pulse lines 376 that transmit fire pulse with different characteristics, such as fire pulses with different frequencies, amplitude and/or durations. For example, each of the fluid ejectors 332 may be connected to a first fire pulse line 376 while each of the fluid pumps 334 are connected to a separate and different fire pulse line 376.

Primitive enabling line 378 receives a data signal when the particular primitive or set 340 to which the fluid ejector 332, fluid pump 334 belongs, is to be enabled for firing. In the example illustrated, in response to receiving a combination of address enabling signals on address line 24 and primitive enabling signals or data signals on primitive enabling line 378, the fluid ejector 332, fluid actuator 334 is actuated in accordance with the fire pulse received on line 376.

Figure 6:
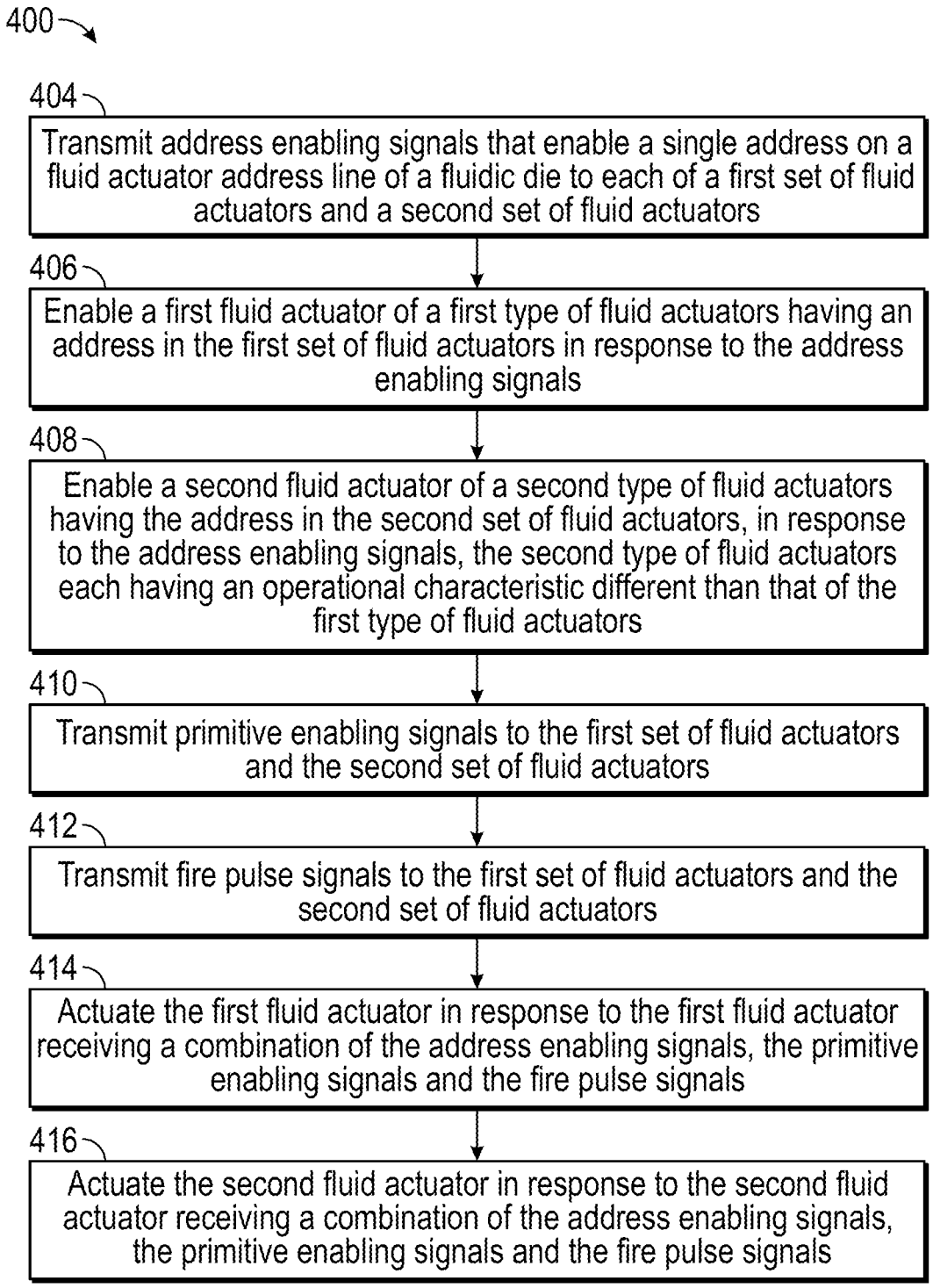
FIG. 6 is a flow diagram of an example method for enabling different types of fluid actuators on a fluidic die.

Fluid ejection controller 310 transmits packets of information to fluidic die 320, wherein logic on die 320 parses out instructions pertaining to which address is to be enabled for a particular actuation event and which printers or sets 340 are to also be enabled such that those fluid ejector 332 and fluid pumps 334 of the different sets 340 that receive both address enabling signals and primitive enabling signals are actuated pursuant to the fire pulse signal received on line 376. FIG. 6 is a flow diagram of an example method 400 for actuating fluid actuators having different operating characteristics and arranged in different primitives are sets on a fluidic die. Although method 400 is described as being carried out by the example fluid ejection system 300 having different fluid actuators in the form of fluid ejectors and fluid pumps, method 400 may also be carried out with any sets of different fluid actuators having different operating characteristics. For example, method 400 may likewise be carried out with sets of different fluid ejectors, each set having at least two types of fluid ejectors, such as different types of fluid ejectors having different drop weights or other different operational characteristics. Method 400 may likewise be carried out with sets of different fluid pumps, each set having at least two types of fluid pumps having different energy demands As indicated by block 404, address line 24 transmits address enabling signals to each of a first set 340A and a second set 340B of fluid actuators 332, 334. The address enabling signals enable a single address on the fluid actuators line 24 of die 20.

As indicated by block 406, in response to the address enabling signals transmitted in block 404, a first actuator of a first type of fluid actuators in a first set of fluid actuators 340A and having the address enabled by the address enabling signals is enabled for actuation during a subsequent actuation event. With reference to FIG. 5, the address enabling signals are received by the logic element 374 of the first fluid actuator.

As indicated by block 408, in response to the address enabling signals transmitted in block 404, a second actuator of a second type of fluid actuators in a second set 340B of fluid actuators and having the address enabled by the address enabling signals is enabled for actuation during a subsequent actuation event. With reference to FIG. 5, the address enabling signals are received by the logic element 374 of the second fluid actuator. The first fluid actuator and the second fluid actuator are different types of fluid actuators. With respect to the example fluidic die 320, the first actuator may be in the form of fluid ejector 332 while the second actuator may be in the form of fluid pump 334, or vice versa.

As indicated by block 410, primitive enabling signals (also sometimes referred to as data signals) are transmitted to each fluid actuator, each fluid ejector 332 and each fluid pump 334, of the first set 340A of fluid actuators and of the second set 340B of fluid actuators. With reference to FIG. 5, the primitive enabling signals are received by the logic element 374 across lines 378 of each fluid ejector 332 and each fluid pump 334, of the first set 340A of fluid actuators and of the second set 340B of fluid actuators. Although blocks 406 and 408 are illustrated as occurring before block 410, it should be appreciated that blocks 406, 408 and 410 may be carried out in any order.

As indicated by block 412, fire pulse signals are transmitted to the first set of fluid actuators and the second set of fluid actuators. The fire pulse signals control the timing, frequency and duration of each logical pulse transmitted to a fluid actuator during actuation. As indicated above, in some implementations, the fire pulse signals may be transmitted independent of the primitive enabling and address signals. In other implementations, the fire pulse signals may be combined upstream with the primitive enabling/data signals.

As indicated by block 414, in response to the first fluid actuator receiving a combination of the address enabling signals on address line 24 and the primitive enabling signals on print enabling line 378, the first actuator of the first type in the first set 340A of fluid actuators is actuated pursuant to the fire pulse received associated fire pulse line 376. As indicated by block 416, in response to the first fluid actuator receiving a combination of the address enabling signals on address line 24 and the primitive enabling signals on primitive enabling line 378, the second actuator of the second type in the second set 340B of fluid actuators is actuated pursuant to the fire pulse received on the associated fire pulse line 376. In some instances, the first actuator may receive an address enabling signal on address line 24 while not receiving primitive enabling signals on primitive enabling line 378, result in the first actuator not being actuated or fired. Likewise, in some instances, the first actuator may receive a primitive enabling signal on primitive enabling line 378 while not receiving an address enabling signal on address line 24, resulting in the first actuator not being fired. The same logic applies with respect to the second actuator.

Figure 7:
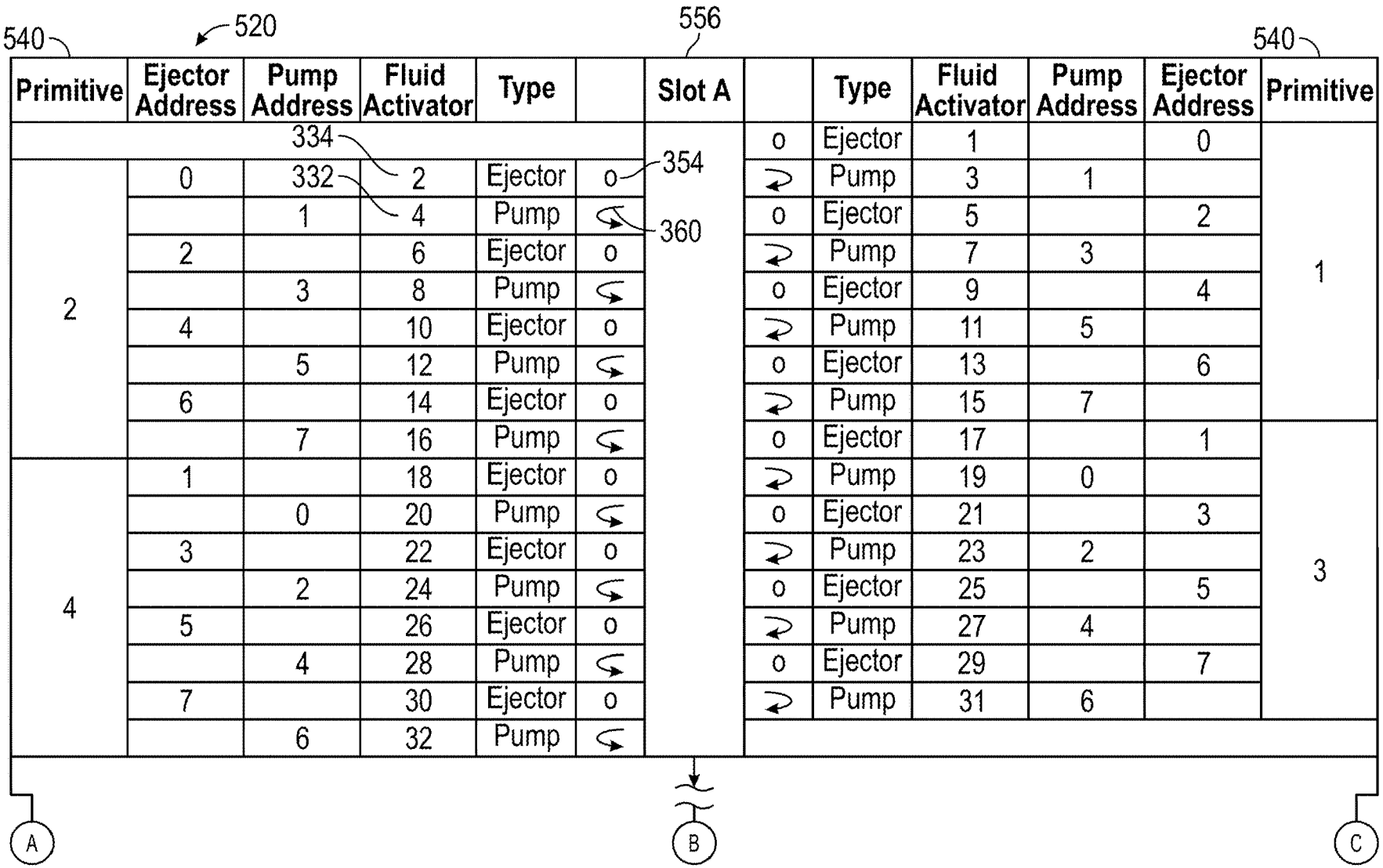
FIG. 7 is a schematic diagram of another example fluidic die
Figure 7:
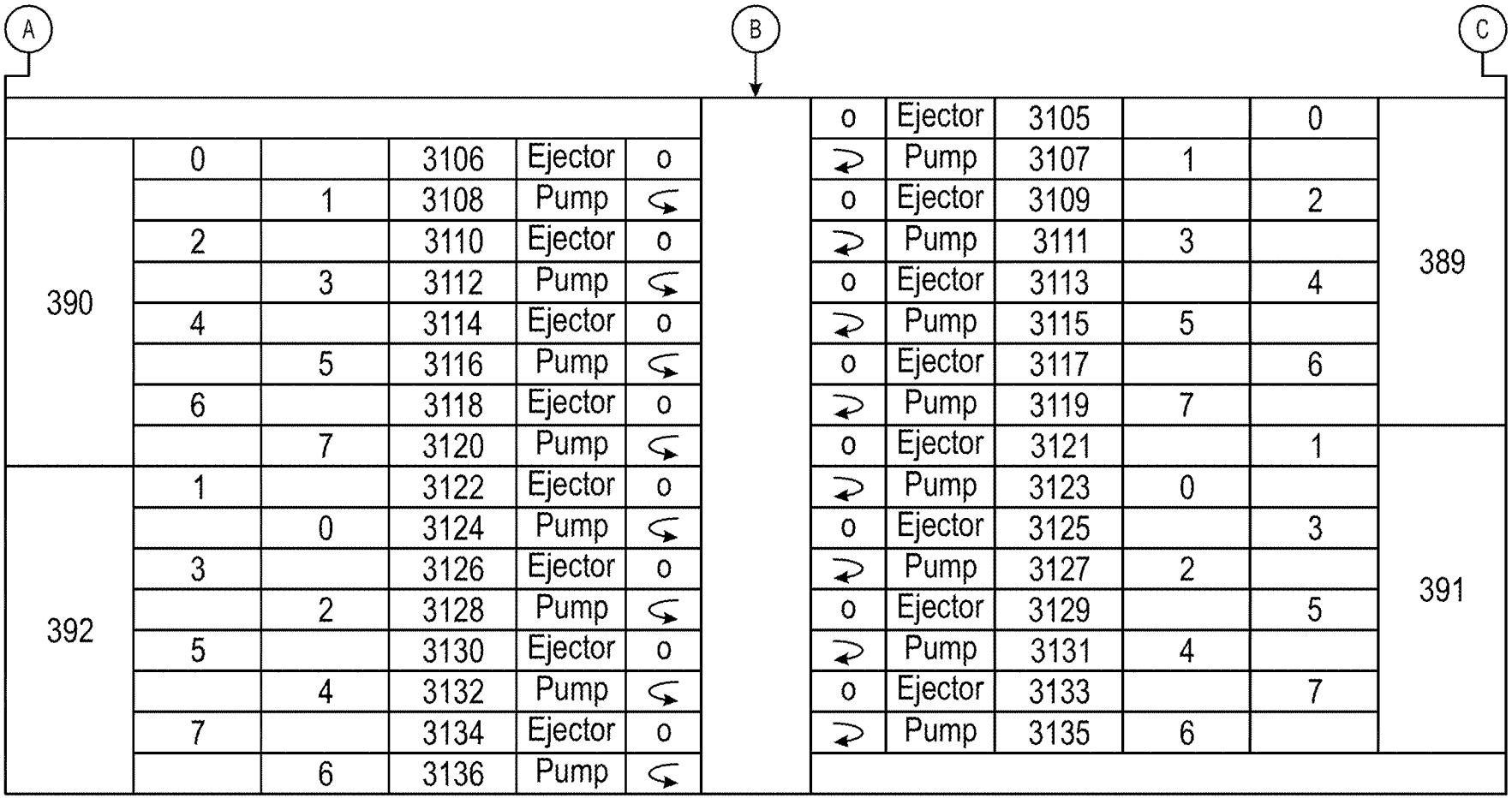

FIG. 7 is a schematic diagram of another example fluidic die 520. Microfluidic die 520 is similar to microfluidic die 320 except that microfluidic die 520 is illustrated as comprising a fluid supply in the form of a fluid slot 556 that supplies fluid to 3136 fluid actuators, alternating between fluid pumps and fluid ejectors, on either side of slot 556 and arranged in primitives or sets 540 (1-391), each set including eight fluid actuators, four fluid ejectors and four fluid pumps. As schematically shown FIG. 7, the ejectors are associated with a nozzle orifice 354 while the pumps are contained within are associated with a microfluidic channel 360.

FIG. 7 illustrates the use of the addressing scheme described above with respect to fluidic dies 20, 120 and 320 on a larger scale. As shown by FIG. 7, and each pair of adjacent or consecutive primitives on a side of slot 556, the set of addresses in the sets are primitives 540 oppositely assigned to the ejectors 332 and pumps 334. For example, in primitive 2, the ejectors have even addresses (0,2,4,6) while the pumps have odd addresses (1,3,5,7). Conversely, in the adjacent or consecutive primitive 4, the ejectors have odd addresses (1,3,5,7) while the pumps have even addresses (0,2,4,61,3,5,7) the same schemas apply with respect to primitives 1, 3, primitives 390, 392, primitive 389, 391 and so on.

As with fluidic die 220 described above, the example addressing scheme of fluidic die 520 may facilitate more flexibility in the actuation order of fluid ejectors 332 and fluid pumps 334. In examples where fluid ejectors 332 and fluid pumps 334 have different energy demands, the example addressing scheme of fluid die 520 may facilitate reduced peak currents. For example, in one implementation where fluid ejectors 332 have higher energy demands and fluid pumps 334 have lower energy demands or peak currents, the number of fluid ejectors is spread out over the total number of addresses in each of sets 540, resulting in half, rather than all, of the total number of fluid ejectors being enabled for possible actuation during a subsequent actuation event. In other words, the first half of the fluid ejectors may be enabled for possible actuation during a first actuation event while a second half of the fluid actuators may be enabled for possible actuation during a second actuation event.

Figure 8:
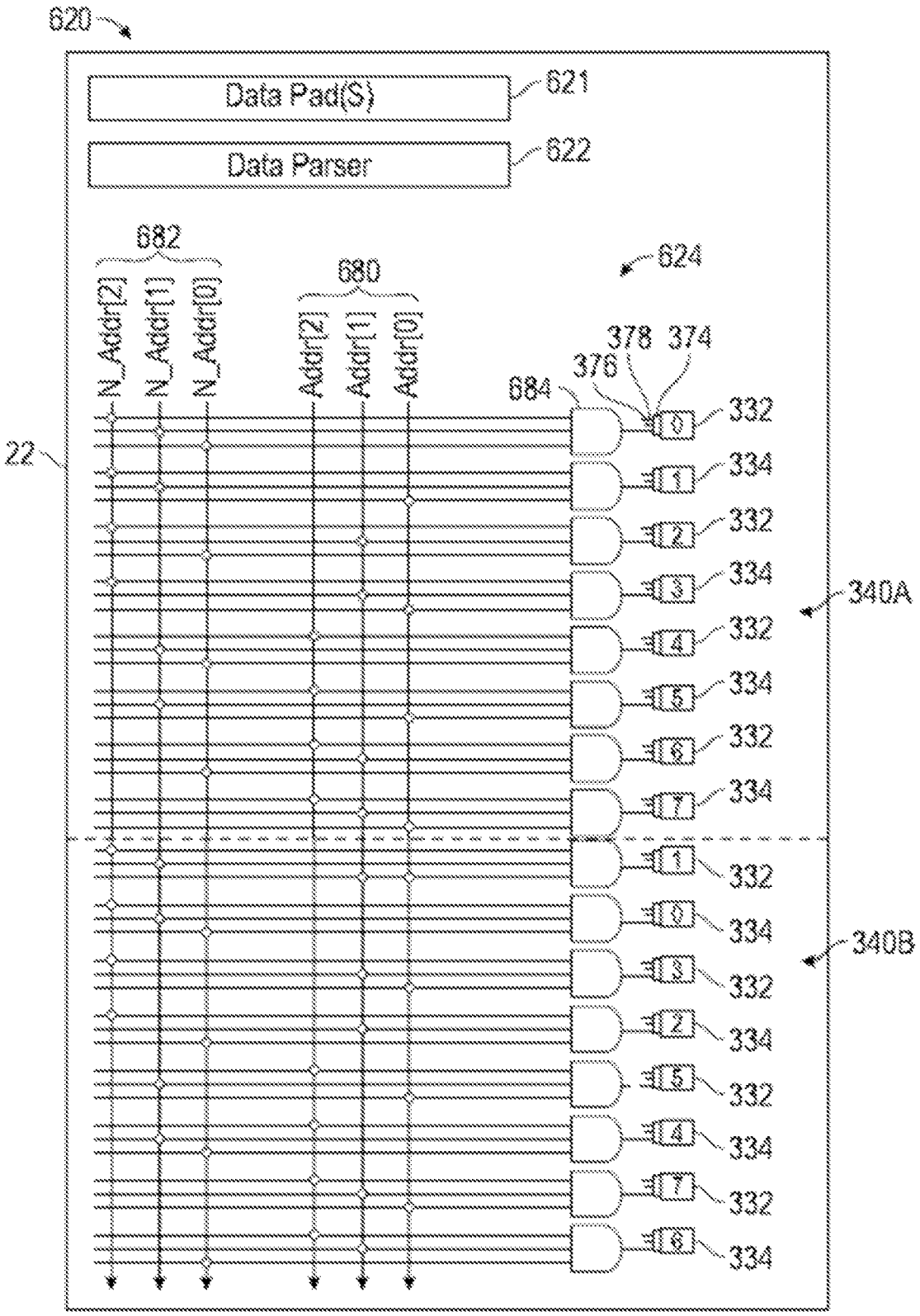
FIG. 8 is a schematic diagram of another example fluidic die, illustrating an example fluid actuator address line for enabling addressed fluid ejectors and fluid pumps.

FIG. 8 is a schematic diagram of a portion of another example fluidic die 620 having data pad 621, data parser 622 and address line 624. Fluidic die 620 additionally comprises each of those components illustrated and described above respect to FIGS. 4 and 5 such as primitives or sets 340 of different fluid ejectors in the form of fluid ejectors 332 and fluid pumps 334 as well as fluid input 358, microfluidic channel 360 and the components of nozzle 350 such as ejection chamber 352 and orifice 354. In the example illustrated, each set 340 comprises eight fluid actuators, four fluid ejectors 332 and four fluid pump 334. As should be appreciated, in other implementations, such as primitives or sets may comprise a greater or smaller number of such fluid actuators. Each fluid ejector 332, fluid pump 334 may comprise the triggering logic 370 as illustrated and described above, but where fluid actuator address line 24 is replaced with fluid actuator address line 624 as illustrated in FIG. 8.

Data pad 621 comprise electric connections by which data packets are received from fluid ejection controller 310 (shown in FIG. 5) data parser 622 comprises electronics or logic that parses the data packet to identify a designated fluid actuator address to be enabled for a particular actuation event. Data parser 622 may transmit signals along address line 624 based upon the designated fluid actuator address.

FIG. 8 illustrates fluid actuator address line 624 and its connection to fluid ejectors 332 and fluid pumps 334 of sets 340A and 340B. Fluid actuator address line 624 comprises address bit lines 680, complementary address bit lines 682 and address decoding logic elements 684. Address bit lines 680 comprise electrically conductive wires or traces on substrate 22 that represent three bits, Addr(0), Addr (1) and Addr(2) and which are connected to or not connected to respective address decoding logic elements 684 based upon the binary address of the fluid actuator 332, 334 connected to the respective address decoding logic elements 684. For example, as shown by FIG. 8, the topmost fluid ejector 332 of set 340A with an address of "0" has an associated logic element 684 that is not connected to Addr(2) (a bit value of 0), that is not connected to Addr(1) (a bit value of 0) and that is not connected to Addr(0) (a bit value of 0), forming a binary value of 000 or zero. Likewise, the topmost fluid pump 334 of set 340A with an address of "1" has an associated logic element 684 that is not connected to Addr (2) (a bit value of 0), that is not connected to Addr(1) (a bit value of 0) and that is connected to Addr(0) (a bit value of 1), forming a binary value of 001 or one. The next actuator, in the form of a fluid ejector having address "2", has an associated logic element 684 that is not connected to Addr (2) (a bit value of 0), that is connected to Addr(1) (a bit value of 1) and that is not connected to Addr(0) (a bit value of 0), forming a binary address value of 010 or two. This binary connection scheme continues for the remaining addresses the 3-7 of the fluid ejectors 332 and fluid pumps 334 of set 340A.

The same binary connection described above with respect to set 340A is applied to set 340B (and any other primitives or sets of fluidic die 620). However, as shown by FIG. 8, the set of addresses 0-7 in set 340B are oppositely assigned to the fluid ejectors 332 and fluid pump 334. Instead of fluid ejectors 332 being assigned even addresses and the fluid pumps 334 being assigned odd addresses, the fluid pumps are assigned even addresses while the fluid ejectors are assigned odd addresses. As with set 340A, the address bit line 680 of fluid actuator address line 624 are connected to the logic element 684 of each fluid ejector 332 or fluid pump 334 based upon the address of the fluid ejector 332 or fluid pump 334. For example, the fluid ejector 332 having an address of "7" has an address decoding logic element 684 that is connected to Addr(2) (a bit value of 1), that is connected to Addr(1) (a bit value of 1), and that is connected to Addr(0) (a bit value of one), forming a binary address value of 111 or seven.

The complementary address bit lines 682 cooperate with address bit lines 680 to transmit signals such that an individual address decoding logic element 684 transmits an address enabling signal to its respective fluid ejector 332 or fluid pump 334 in response to an individual fluid ejector 332 or fluid pump 334 being addressed by line 624. The complementary address bit lines 682 comprise electrically conductive wires or traces on substrate 22 that are connected to or not connected to the logic element 682 of the different fluid ejectors 332 and fluid pumps 334 based upon the address of the respective fluid ejector 332, fluid pumps 334. The complementary address bit lines 682 for a particular logic element 684 for a particular fluid ejector 332 or fluid pump 334 have connections that are the opposite of the connections of the respective address bit line 680 to the same particular fluid ejector 332 or fluid pump 334. For example, in set 340A, the fluid ejector 332 with an address of "4" has a logic element 684 connected to address bit line Addr(2) but not connected to the remaining address bit lines Addr(1) and Addr(2) to form a binary address of 100 with a value of 4. Accordingly, the same address decoding logic element 682 for the fluid ejector 332 having an address of "4" is connected to address bit lines 682 in a complementary or opposite fashion, not being connected to Addr(2) while being connected to Addr(1) and Addr(0). In one implementation, the connections between each of the logic element 684 and the address bit line 680 and complementary address bit line 682 is made on substrate 22 with metal 2 layer jumpers.

In the example illustrated in FIG. 8, the address to be enabled in each of the sets 340 of fluid ejector 332 and fluid pumps 334 is carried out by selectively connecting the different address bit line 680 and complementary address bit line 682 to a high "1" or a low "0" voltage level. Such selective connection may be made by actuation logic utilizing transistors or other switches. For example, to transmit the address "5" along line 624 to concurrently enable the fluid pump 334 in set 340A having address "5" and the fluid ejector 332 in set 340B having address "5", the address bit lines Addr(2) and Addr(0) of the address bit lines 680 and the complementary address bit line N Addr(1) are connected to a high "1" voltage level. At the same time, the address bit line Addr(1) of the address bit line 680 and the address bit lines N Addr(2) and N Addr(0) of the complementary address bit lines 682 are connected to a low "0" voltage, either I a null or zero voltage or a negative voltage. The other fluid ejectors 332 and fluid pumps 334 may receive enabling signals via fluid actuator address line 624 in a similar fashion.

In the example illustrated, address decoding logic elements 684 comprise AND logic such as a gate or other electronic circuitry that provide AND logic, wherein the output results in response to all of the input lines being active or the signals. In other implementations, address decoding logic elements 684 may comprise other electronic circuitry that decodes the address being transmitted along bit lines 680 and 682. Still other implementations, addresses may be transmitted along address data line 624 using other numbers or combinations of bit lines as well as other address encoding circuitry or elements.

In the examples shown in FIGS. 4-5 and FIG. 8, examples of an embedded addressing scheme are described. It should be appreciated that in other implementations, other addressing schemes other than embedded addressing schemes may be employed. For example, addressing schemes employing the direct wiring of address lines may be employed, wherein the enabling or firing order of primitives of fluid actuators is alternated as described above.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A fluidic die comprising:

a substrate supporting a fluid actuator address line;

a first set of fluid actuators connected to the fluid actuator address line, the first set of fluid actuators comprising:

a first subset of fluid actuators of a first type of fluid actuators; and a second subset of fluid actuators of a second type of fluid actuators having different operating characteristics than the first type of fluid actuators;

a second set of fluid actuators connected to the fluid actuator address line, the second set of fluid actuators comprising:

a third subset of fluid actuators of the first type; and a fourth subset of fluid actuators of the second type, wherein a first fluid actuator of the first type in the first subset of fluid actuators and a first fluid actuator of the second type in the fourth subset of fluid actuators are enabled responsive to a common address of a single address enabling event on the fluid actuator address line.

2. The fluidic die of claim 1, wherein each subset of the first subset of fluid actuators and the fourth subset of fluid actuators is enabled by a first set of addresses, and wherein each subset of the second subset of fluid actuators and the third subset of fluid actuators is enabled by a second set of addresses different from the first set of addresses.

3. The fluidic die of claim 2, wherein the first set of addresses includes even numbered addresses, and wherein the second set of addresses includes odd numbered addresses.

4. The fluidic die of claim 2, wherein each address in the first set of addresses is distinct from each address in the second set of addresses.

5. The fluidic die of claim 1, wherein the first type of fluid actuators has a first actuation energy demand, and wherein the second type of fluid actuators has a second actuation energy demand different than the first actuation energy demand.

6. The fluidic die of claim 5, wherein a fluid actuator of the first type of fluid actuators is to eject fluid through corresponding nozzles, and wherein a fluid actuator of the second type of fluid actuators is to circulate fluid to a firing chamber.

7. The fluidic die of claim 1, wherein a fluid actuator of the first type of fluid actuators is to eject fluid through corresponding nozzles and wherein a fluid actuator of the second type of fluid actuators is to circulate fluid to a firing chamber.

8. The fluidic die of claim 1, further comprising a third set of fluid actuators connected to the fluid actuator address line adjacent the second set of fluid actuators, the second set of fluid actuators being between the first set of fluid actuators and the second set of fluid actuators, the third set of fluid actuators comprising:

a fifth subset of fluid actuators of the first type of fluid actuators; and a sixth subset of fluid actuators of the second type of fluid actuators, wherein a fluid actuator of the fifth subset of fluid actuators is enabled by the common address of the single address enabling event on the fluid actuator address line.

9. The fluidic die of claim 1, wherein the fluid actuator address line comprises a first set of address bit lines and a second set of complementary address bit lines, wherein the first fluid actuator of the first type in the first subset of fluid actuators and the first fluid actuator of the second type in the fourth subset of fluid actuators each has logic coupled to a same combination of the first set of address bit lines and a same combination of the second set of complementary address bit lines.

10. The fluidic die of claim 1, wherein fluid actuators of the first subset of fluid actuators alternate with fluid actuators of the second subset of fluid actuators in the first set of fluid actuators, and wherein fluid actuators of the third subset of fluid actuators alternate with fluid actuators of the fourth subset of fluid actuators in the second set of fluid actuators.

11. The fluidic die of claim 1, wherein the common address concurrently enables different types of fluid actuators in the first set of fluid actuators and the second set of fluid actuators.

* * * * *